US011127358B2

(12) United States Patent
Park et al.

(10) Patent No.: US 11,127,358 B2
(45) Date of Patent: Sep. 21, 2021

(54) DISPLAY DEVICE AND DISPLAYING METHOD THEREOF

(71) Applicant: Samsung Display Co., Ltd., Yongin-Si (KR)

(72) Inventors: Hee Sook Park, Suwon-si (KR); Ki Hyun Pyun, Gwangmyeong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/993,197

(22) Filed: Aug. 13, 2020

(65) Prior Publication Data

US 2021/0256914 A1 Aug. 19, 2021

(30) Foreign Application Priority Data

Feb. 18, 2020 (KR) ..... 10-2020-0019813

(51) Int. Cl.
*G09G 3/3291* (2016.01)

(52) U.S. Cl.
CPC ..... *G09G 3/3291* (2013.01); *G09G 2310/08* (2013.01); *G09G 2320/0233* (2013.01); *G09G 2320/046* (2013.01); *G09G 2360/12* (2013.01)

(58) Field of Classification Search
CPC ..... G09G 2320/046
See application file for complete search history.

(56) References Cited

U.S. PATENT DOCUMENTS

| | | | | |
|---|---|---|---|---|
| 7,865,846 | B2 * | 1/2011 | Kim | G09G 3/22 715/867 |
| 10,852,905 | B1 * | 12/2020 | Guzman | G06F 9/451 |
| 2005/0024391 | A1 * | 2/2005 | Damera-Venkata | G09G 3/007 345/698 |
| 2005/0093850 | A1 * | 5/2005 | Mori | G09G 3/007 345/204 |
| 2006/0221186 | A1 * | 10/2006 | Lin | H04N 7/0122 348/173 |
| 2007/0019007 | A1 * | 1/2007 | Jung | G09G 3/20 345/698 |
| 2007/0096767 | A1 * | 5/2007 | Tsai | G09G 3/007 324/760.01 |

(Continued)

FOREIGN PATENT DOCUMENTS

| | | | |
|---|---|---|---|
| JP | 5862863 | B2 | 2/2016 |
| KR | 10-0497344 | B1 | 9/2005 |

(Continued)

*Primary Examiner* — Sepehr Azari
(74) *Attorney, Agent, or Firm* — Innovation Counsel LLP

(57) ABSTRACT

A display device includes a display panel, a display driver, and a timing controller. The data driver may apply a first data voltage set and subsequently a second data voltage set to the display panel during a screen saver operation of the display device. The first data voltage set may cause the display panel to display a first illuminated area. The second data voltage set may cause the display panel to display a second illuminated area. The timing controller may supply image data to the data driver for the second data voltage set to cause the second illuminated area to have a luminance level. The timing controller may determine a value for controlling the luminance level based on a distance between a position of the first illuminated area and a position of the second illuminated area.

20 Claims, 12 Drawing Sheets

(56) References Cited

U.S. PATENT DOCUMENTS

| | | | | |
|---|---|---|---|---|
| 2007/0109284 | A1* | 5/2007 | Yamazaki | G09G 3/3225 345/204 |
| 2008/0106649 | A1* | 5/2008 | Prusia | G09G 5/003 348/701 |
| 2010/0117932 | A1* | 5/2010 | Yamashita | G09G 3/3225 345/55 |
| 2011/0154270 | A1* | 6/2011 | Sonoda | H04N 5/781 715/867 |
| 2015/0130860 | A1* | 5/2015 | Park | G09G 3/3648 345/691 |
| 2016/0260413 | A1* | 9/2016 | You | G09G 5/10 |
| 2018/0032248 | A1* | 2/2018 | Kim | G06F 3/0412 |
| 2018/0286356 | A1* | 10/2018 | Jiang | G09G 5/36 |
| 2018/0350296 | A1* | 12/2018 | Thompson | G06F 3/0643 |
| 2019/0027077 | A1* | 1/2019 | Kudo | G09G 3/2092 |
| 2019/0286321 | A1* | 9/2019 | Kim | G06F 1/3262 |
| 2020/0410930 | A1* | 12/2020 | Takasugi | G09G 3/3225 |
| 2021/0082375 | A1* | 3/2021 | Hong | G09G 5/38 |

FOREIGN PATENT DOCUMENTS

| | | | |
|---|---|---|---|
| KR | 10-0512561 | B1 | 9/2005 |
| KR | 10-1526351 | B1 | 6/2015 |
| KR | 10-2018-0095409 | A | 8/2018 |

* cited by examiner

DISPLAY DEVICE AND DISPLAYING METHOD THEREOF

CROSS-REFERENCE TO RELATED APPLICATION

This application claims priority to Korean Patent Application No. 10-2020-0019813, filed in the Korean Intellectual Property Office on Feb. 18, 2020; the Korean Patent Application is incorporated herein by reference.

BACKGROUND

1. Field

The technical field relates to a display device and a method of operating the display device.

2. Description of the Related Art

Modern display devices include liquid crystal displays and organic light emitting diode displays.

A liquid crystal display typically includes a backlight unit and displays an image by partially and selectively transmitting light emitted from the backlight unit.

An organic light emitting diode display is self-luminous and does not require a backlight unit.

Display devices may be included in electronic devices, such as mobile phones, televisions, and monitors. In general, it is desirable to minimize power consumption of display devices.

The above information disclosed in this Background section is for enhancement of understanding of the background of the described technology. The Background section may contain information that does not form the prior art that is already known in this country to a person of ordinary skill in the art.

SUMMARY

Embodiments may be related a display device with low power consumption. Embodiment may be related to an organic light emitting diode display having a long lifespan and a late burn-in start time.

Embodiments may be related to a display device in which a luminance change during a screen saver operation is inconspicuous.

An embodiment may be related a display device that includes the following elements: a display panel configured to include a plurality of pixels; a data driver configured to apply a data voltage to the pixels; and a timing controller configured to supply image data to the data driver, wherein when a display area changes from a first display area to a second display area during a screen saver operation, the timing controller displays luminance of the second display area differently depending on a distance between the first display area and the second display area.

Luminance of the second display area may be displayed as a first luminance having a low luminance value when the distance between the first display area and the second area is small, and luminance of the second display area may be displayed as a second luminance having a high luminance value when the distance between the first display area and the second area is large.

When the distance between the first display area and the second display area is small, it may be less than a first reference distance; when the distance between the first display area and the second display area is large, it may be greater than a first reference distance; and when the distance between the first display area and the second display area is between the first reference distance and the second reference distance, it may be displayed as an intermediate luminance between the first luminance and the second luminance.

The display panel may be divided into a plurality of blocks arranged in a matrix form, and the distance may be indicated based on the blocks.

When a same screen is displayed for a predetermined time or longer, the screen saver operation may gradually decrease luminance of the display area to display minimum luminance.

The timing controller may include: first and second frame memories; a first total load summation unit connected with the first frame memory; a second total load summation unit connected with the second frame memory; a total load comparison unit connected to the first and second total load summation units; a load comparison unit for each block, connected to the first and second frame memories; and a gain determination unit configured to receive outputs of the total load comparison unit and the load comparison unit for each block to determine a gain value.

The timing controller may further include a counter, and the counter may transfer the final counted value to the gain determination unit.

The counter may output an enable signal to allow the load comparison unit for each block and the gain determination unit to operate.

The final counted value may be compared with a counter threshold value, and the enable signal may be outputted when it is greater than the counter threshold value.

The total load comparison unit may compare a threshold value for a total load value and a difference between total load values of the first and second total load summation unit, and may not output an enable signal to the gain determination unit when it is smaller than the threshold value for the total load value.

The first and second frame memories may include a plurality of frame memories for each of the first and second blocks, respectively, and the load comparison unit for each block may compare a load threshold value for each block with a difference between values stored in each of the first and second blocks, and may process the load value for each block as unchanged when it is smaller than the load threshold value for each block.

The gain determination unit may receive block coordinate information from the load comparison unit for each block to calculate a final gain.

The gain determination unit may include: a block coordinate information reception unit configured to receive the block coordinate information from the load comparison unit for each block; first and second coordinate analysis units configured to respectively recognize an x-axis distance and a y-axis distance by using the block coordinate information; a first gain calculation unit configured to obtain an x-axis gain value based on the x-axis distance checked by the first coordinate analysis unit; a second gain calculation unit configured to obtain a gain value of the y-axis distance based on the y-axis distance checked by the second coordinate analysis unit; a synthesis unit configured to synthesize the x-axis gain value and the y-axis gain value from the first and second gain calculation units to generate a gain value according to the total distance; and a final gain calculation unit configured to calculate a final gain value based on the gain value depending on the total distance.

The final gain calculation unit may receive the final counted value from the counter to determine the final gain value based on the final counted value.

An embodiment may be related to an operation method of a display device. The method may include the following steps: a first step of comparing total load values of a previous frame and a current frame to check whether there is a change; a second step of comparing a load value for each block of the previous frame and the current frame to check whether there is a change; a third step of operating a screen saver when there are no changes in the first step and the second step; and a fourth step of compensating display luminance based on a distance between blocks having a change when there is no change in the first step but there is a change in the second step.

The compensating of the display luminance may include: analyzing position information between the blocks having a change to recognize a distance; and compensating the display luminance based on the distance, and the compensating of the display luminance may include displaying a first luminance having low luminance when the distance is small and a second luminance having high luminance when the distance is large.

The first step may be processed to see that there is no change when a result of comparing the total load value is less than a threshold value for a total load value.

The second step may be processed to see that there is no change when a result of comparing the load value for each block is less than a threshold value for a load value for each block.

The fourth step may be performed when the third step is performed for a predetermined time or longer.

The screen saver of the third step may display a minimum luminance by gradually reducing display luminance when a same screen is displayed for a certain period of time or more.

An embodiment may be related to a display device. The display device may include a display panel, a display driver, and a timing controller. The data driver may be electrically connected to the display panel and may apply a first data voltage set and subsequently a second data voltage set to the display panel during a screen saver operation of the display device. The first data voltage set may cause the display panel to display a first illuminated area immediately neighboring a first unilluminated area. The second data voltage set may cause the display panel to display a second illuminated area immediately neighboring a second unilluminated area. The timing controller may be electrically connected to the data driver and may supply image data to the data driver for the second data voltage set to cause the second illuminated area to have a luminance level. The timing controller may determine a luminance-related value for controlling the luminance level based on a distance-related number that depends on a distance between a position of the first illuminated area and a position of the second illuminated area.

The timing controller may determine the luminance-related value to be a first value when the distance-related number is a first number. The timing controller may determine the luminance-related value to be a second value greater than the first value when the distance-related number is a second number greater than the first number.

The first number may be less than a first reference number. The second number may be greater than a second reference number. The timing controller may determine the luminance-related value to be greater than the first value and less than the second value when the distance-related number is greater than the first reference number and less than the second reference number.

The display panel may be divided into blocks arranged in a matrix form. The distance-related number may be a quantity of one or more of the blocks.

When the first illuminated area has been illuminated for a predetermined time or longer, the timing controller may cause luminance of the first illuminated area to gradually decrease to a predetermined luminance level.

The display panel may be divided into blocks. The timing controller may include the following elements: a first frame memory; a second frame memory; a first total load summation unit connected to the first frame memory; a second total load summation unit connected to the second frame memory; a total load comparison unit connected to each of the first total load summation unit and the second total load summation unit; a block load comparison unit connected to each of the first frame memory and the second frame memory; and a gain determination unit configured to receive outputs of the total load comparison unit and the block load comparison unit to determine the luminance-related value.

The timing controller may further include a counter configured to transfer a counted value to the gain determination unit.

The counter may output an enable signal to activate each of the block load comparison unit and the gain determination unit.

The counter may compare the counted value with a counter threshold value. The counter may output the enable signal when the counted value is greater than the counter threshold value.

The total load comparison unit may compare a threshold value with a difference between a total load value of the first total load summation unit and a total load value of second total load summation unit. The total load comparison unit may output no enable signal to the gain determination unit when the difference is smaller than the threshold value.

The first frame memory may store first image data related to a previous frame for all of the blocks. The second frame memory may store second image data related to a current frame for all of the blocks. The block load comparison unit may compare a load threshold value with a difference between values stored in the first frame memory and the second frame memory for each of blocks. The block load comparison unit may treat a load value of a block as unchanged when a difference associated with the block is smaller than the load threshold value.

The gain determination unit may receive block coordinate information from the block load comparison unit to calculate the luminance-related value. The block coordinate information may be related to the position of the second illuminated area.

The gain determination unit may include the following elements: a block coordinate information reception unit configured to receive the block coordinate information from the block load comparison unit; a first coordinate analysis unit and a second coordinate analysis unit configured to respectively recognize x-axis distance information and y-axis distance information using the block coordinate information; a first gain calculation unit configured to obtain an x-axis gain value based on the x-axis distance information; a second gain calculation unit configured to obtain a y-axis gain value based on the y-axis distance information; a synthesis unit configured to synthesize the x-axis gain value and the y-axis gain value generate a synthesized gain value; and a gain calculation unit configured to calculate the luminance-related value based on the synthesized gain value.

The gain calculation unit receives the counted value from the counter to determine the luminance-related value based on the counted value.

An embodiment may be related to an operating method of a display device that includes a display panel. The method may include the following steps: a first step of comparing a total load value of a previous frame and a total load value of a current frame to check a first condition related to whether a total load change exceeds a total load change threshold; a second step of comparing a load value of the previous frame and a load value of the current frame for each block to check a second condition related to whether a block load change exceeds a block load change threshold; a third step of performing a screen saver operation when both the first condition and the second condition are false; and a fourth step of adjusting luminance of a second illuminated area on the display panel based on a distance between a positon of the second illuminated area and a position of a first illuminated area on the display panel when the first condition is false but the second condition is true. The first illuminated area may immediately neighbor a first unilluminated area on the display panel. The second illuminated area may immediately neighbor a second unilluminated area on the display panel.

The fourth step may include the following steps: setting the luminance of the second illuminated area to a first luminance level when the distance is represented by a first number; and setting the luminance of the second illuminated area to be a second luminance level higher than the first luminance level when the distance is represented by a second number greater than the first number.

The total load change threshold may be greater than zero.

The block load change threshold may be greater than zero.

The fourth step may be performed when the third step has been performed for a predetermined time or longer.

The third step may include gradually reducing luminance of the first illuminated area to a predetermined luminance level when the first illuminated area has been illuminated for a predetermined length of time or more.

According to embodiments, a display device may reduce power consumption by gradually reducing display luminance when a screen saver operation is performed and a same area of the display device has been illuminated for a predetermined length of time or more. This reduction in power consumption is more significant as the display device is larger. In an organic light emitting diode display, a lifespan of an organic light emitting diode may be prolonged, and/or a burn-in phenomenon may be reduced or delayed.

In embodiments, when the illuminated area is changed and/or moved during the screen saver operation, the luminance of the illuminated area is adjusted based on the distance of the movement, so the user may not visually recognize the difference in luminance and may not unnecessarily misconstrue the display device to be defective.

DETAILED DESCRIPTION

Figure 1:
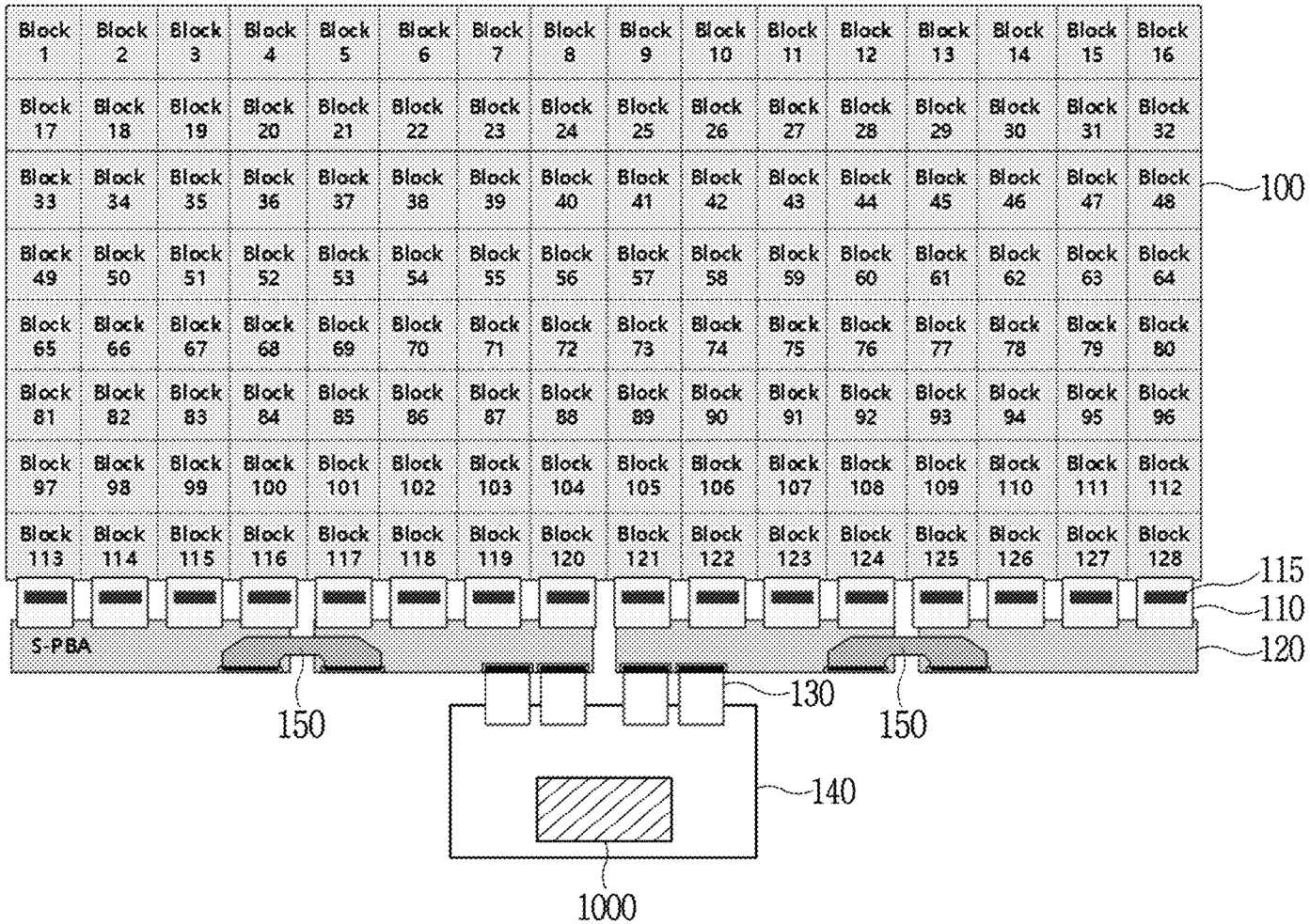
FIG. 1 illustrates a schematic diagram of a display device according to an embodiment.

Example embodiments are described with reference to the accompanying drawings. The described embodiments may be modified in various ways.

In the description, like numerals may refer to like elements.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set), " "second-type (or second-set)," etc., respectively.

In the drawings, dimensions may be exaggerated for clarity.

When a first element is referred to as being "on" a second element, the first element can be directly on the second element, or one or more intervening elements may be present between the first element and the second element. When a first element is referred to as being "directly on" a second element, no intervening elements (except environmental elements such as air) may be intended or required between the first element and the second element. The word "on" or "above" may mean being positioned on or below the object portion, and does not necessarily mean being positioned on the upper side of the object portion based on a gravitational direction.

Unless explicitly described to the contrary, the word "comprise" and variations such as "comprises" or "comprising" may imply inclusion of stated elements but may not require exclusion of any other elements. The term "connect" may mean "electrically connect." The term "drive" may mean "operate" or "control."

FIG. 1 illustrates a schematic diagram of a display device according to an embodiment.

The display device may include a display panel 100; flexible printed circuit boards 110, 130, and 150; printed circuit boards 120 and 140; a data driver 115; and a timing controller 1000.

The display panel 100 may include a plurality of pixels. The display panel 100 may be a liquid crystal display panel (including liquid crystal) or a light emitting display panel (including a light emitting element). The size of the display panel 100 may depend on the embodiment.

The pixels included in the display panel 100 are controlled depending on various control signals, including a scan signal and a data voltage. A power supply voltage having a constant voltage may also be applied to the pixels.

The display panel 100 may be a liquid crystal display panel. Data voltages and scan signals are applied to the pixels. The data voltage applied to a pixel generates an electric field with a common voltage, and orientations of liquid crystal molecules in the pixel are controlled by the electric field, for controlling transmission of light supplied from a light unit.

The display panel 100 may be a light emitting display panel, such as an organic light emitting display panel including an organic emission layer. In the organic light emitting display panel, each pixel may receive a data voltage, a scan signal, a driving voltage (which is a power supply voltage), and a driving low voltage. In addition, an emission signal may be applied to each pixel. In a pixel of the organic light emitting display panel, the output current of the driving transistor is determined based on the data voltage, and an output current flows through the organic light emitting diode to emit light. The luminance of light emitted by the organic light emitting diode depends on an amount of current flowing through the organic light emitting diode.

Although not illustrated in FIG. 1, the display panel 100 includes a scan driver for generating scan signals. The scan driver may be mounted on a portion of the display panel 100. The scan driver may be formed in a process of forming the pixels.

A driver supplying the emission signal may also be formed in the process of forming the pixels and may be included in the display panel 100.

In an embodiment, the data driver 115 for applying a data voltage is disposed on the first flexible printed board 110, and the timing controller 1000 is formed on the second printed circuit board 140.

The timing controller 1000 generates image data and a control signal based on an image signal inputted from an external device. The data driver 115 receives the image data from the timing controller 1000 and changes it to a data voltage set that is to be applied to the pixels.

Image data and a data control signal outputted from the timing controller 1000 are transferred to data drivers 115 on the first flexible board 110 through the second printed circuit board 120, the second flexible printed board 130, and the second printed circuit board 140. A scan control signal outputted from the timing controller 1000 are transferred to a scan driver on the display panel 100 through the second printed circuit board 140, the second flexible printed board 130, the first printed circuit board 120, and the first flexible printed board 110.

Referring to FIG. 1, four first printed circuit boards 120 are provided in two pairs. The two first printed circuit boards 120 constituting one pair are electrically connected to each other by a third flexible printed board 150. When a signal outputted from the timing controller 1000 is firstly applied to a first printed circuit board 120 through the second printed circuit board 140 and the second flexible printed board 130, it is transferred to another first printed circuit board 120 through the third printed circuit board 150.

Referring to FIG. 1, a total of 16 first flexible printed boards 110 are included, and a total of 16 data drivers 115 are included. The data drivers 115 may be attached onto the first printed circuit boards 120 as an IC chips.

The timing controller 1000 may be attached to the second printed circuit board 140 in the form of an IC chip.

The second printed circuit board 140 may further include a power voltage generator for generating a power voltage.

The display panel 100, the flexible printed boards 110, 130, and 150, and the printed circuit boards 120 and 140 are attached by an anisotropic conductive film (ACF), and are electrically connected to each other.

According to an embodiment, the display device may include only one flexible printed circuit board and one printed circuit board PCB. In this case, the timing controller 1000 may be disposed on the printed circuit board, and the data drivers 115 may be disposed on a flexible printed board or attached to the display panel 100.

Referring to FIG. 1, the display panel 100 includes a plurality of blocks. The display panel 100 is not physically divided into blocks, but is conceptually divided when the data drivers 115 and timing controller 1000 drive the pixels. One column of blocks corresponds to one data driver 115, such that the display panel 100 has a total of 16 blocks in a row direction. Referring to FIG. 1, the number of blocks in the row direction is equal to each of the number of the data drivers 115 and the number of first flexible printed boards 110.

Since the number of blocks in each column is 8, the display panel 100 includes a total of 128 blocks. When the size of the display panel 100 is 55 inches or more, the display panel 100 may be divided into 128 blocks. Although the number of blocks may be configured according to embodiments, the following description will be made based on examples in which a display panel is divided into 128 blocks.

Figure 2:
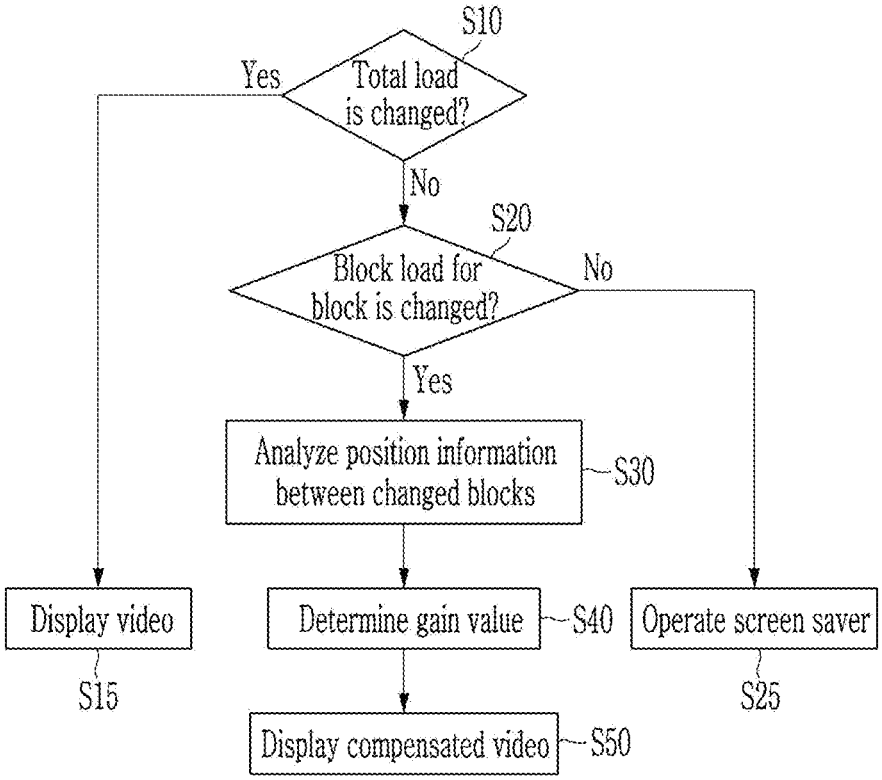
FIG. 2 illustrates a flowchart showing a driving method (i.e., operating method) of a display device according to an embodiment.

FIG. 2 illustrates a flowchart showing a driving method of a display device according to an embodiment.

The driving method illustrated in FIG. 2 is related to a screen saver operation when a user has not provided input to the display device for a predetermined time or more.

An operation illustrated in FIG. 2 may be performed by the timing controller 1000.

First, the timing controller 1000 may determine whether there is a change by comparing total load values of a previous frame and a current frame based on an image signal for each frame provided to the timing controller 1000 (S10). The total load value of the image signal of one frame may be a simple sum of image data to be supplied to the pixels.

When there is a change in the total load value between two adjacent frames, a displayed image may be a video, and a video signal inputted into the timing controller 1000 is processed to transfer the video data to the data driver 115 to display the video (S15). In step S15, the display panel 100 displays an image independent of an operation of the screen saver.

In step S10, the difference between the total load values may be compared with a threshold value. The timing controller 1000 may disregard the difference/change as if there is no change when the difference is smaller than or equal to the threshold value. This is to ensure that the screen saver is properly operated when applicable.

If the timing controller 1000 (in step S10) determines that there is no or negligible total load change, the timing controller further determines whether there is a change by comparing load values for each block in the previous frame and the current frame (S20). This is to check whether an image displayed at each block is changed.

In step S20, the load value change for each block may be compared with a threshold value, which may be less than or equal to the threshold value in step S10. The timing controller 1000 may disregard the load value change as if there is no change when the load value change is smaller than or equal to the step S20 threshold value for each block.

When there is no (or negligible) change in the total load values in step S10 and when there is no (or negligible) change in the load value for each block in step S20, the screen saver may be operated (S25).

Operation of the screen saver may be started when there is no change in the load values (total load value and load value for each block) in S10 and S20 continuously for a certain length of time or more. The screen saver only when the display device does not receive user input for a predetermined time length or longer. This time length may be calculated through a counter.

Specifically, the comparing of the load value for each block to check whether it is changed (S20) is determined by comparing the load values in each block in the current frame N Frame and the previous frame (N−1) Frame. Since the display panel has 128 blocks, comparison is performed for each of the 128 blocks, and the load value of each block may be a simple sum of image data to be applied to pixels belonging to the block.

When each of all the 128 blocks has a same load value in previous and subsequent frames, the display panel may display a still image. When the still image continues for a certain period of time, the operation of the screen saver is performed to protect the display device (S25). The operation of the screen saver of S25 is described with reference to FIG. 3 and FIG. 4.

When the total load value of one frame is unchanged but the load value of one or more blocks is changed, the change may be caused by an image change displayed for the screen saver, and step S30 may be performed.

In step S30, the timing controller 1000 may identify changed blocks and may determine position information between different blocks to check the distance. Herein, a distance value (a distance-related number) may be a value indicating how many blocks are disposed between two blocks, not a length.

In step S40, the timing controller 1000 may determine a gain value based on the distance. For example, when a distance between blocks having load value changes is short, the timing controller 1000 may determine a low gain value. When the distance between blocks having load value changes is long, the timing controller 1000 may determine a high gain value. This is to prevent the user from easily detecting the change in luminance, because a luminance change may be conspicuous when the distance is short, and because a luminance change may be inconspicuous when the distance is long.

The determined gain value may be multiplied with the image data, and accordingly, the data voltage set is provided by the data driver 115 to the pixels of the display panel 100 to display a compensated image (S50).

Herein, the luminance corresponding to a highest gain value may be substantially equal to the luminance corresponding to the inputted image data.

Steps S30, S40, and S50 are further described with reference to FIG. 7 to FIG. 10.

In embodiments, only when the operation of the screen saver (S25) is performed for a certain period of time or more (see t2 in FIG. 3), step S30 may be performed for analyzing position information between blocks. To compensate the screen saver operation through steps S30, S40, and S50 is to eliminate a problem that a user recognizes a luminance drop during the operation of the screen saver as the luminance value is rapidly increased; thus, compensation may not be necessary when there is not much difference in display luminance shortly after the screen saver operation has been performed.

The operation of step S25 of FIG. 2 is described with reference to FIG. 3 and FIG. 4.

Figure 3:
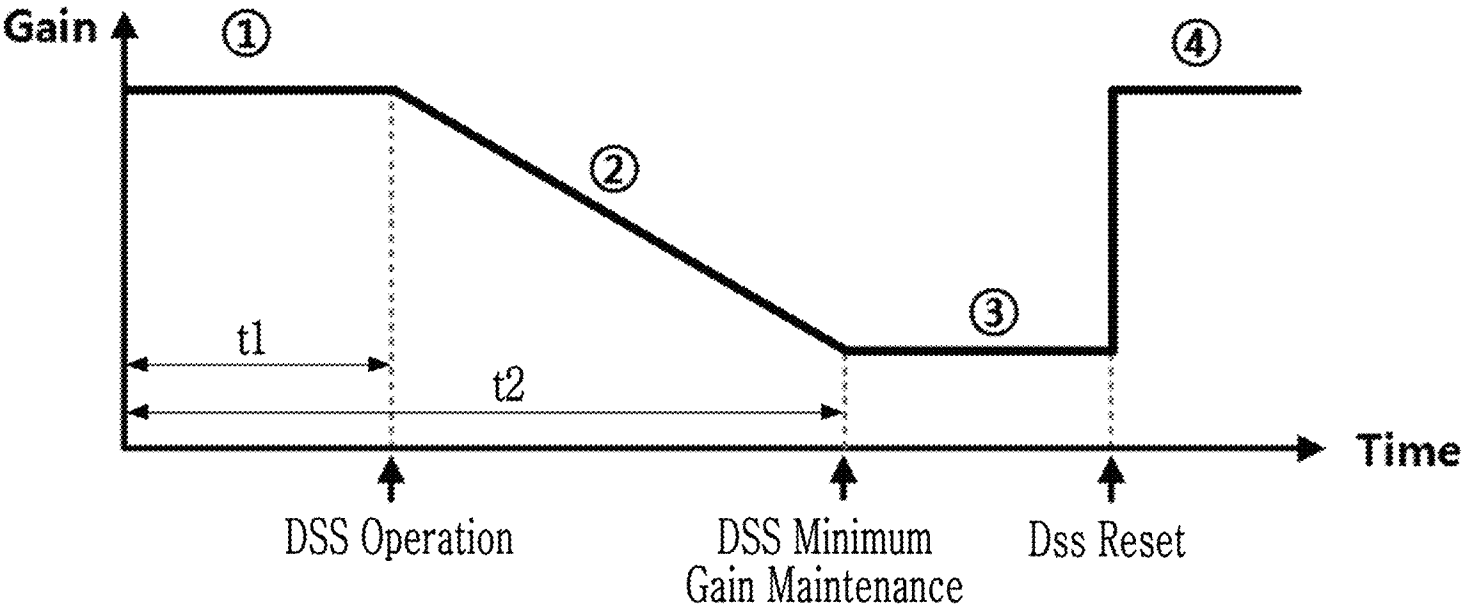
FIG. 3 and FIG. 4 illustrate changes depending on a screen saver operation in a display device according to an embodiment.
Figure 4:
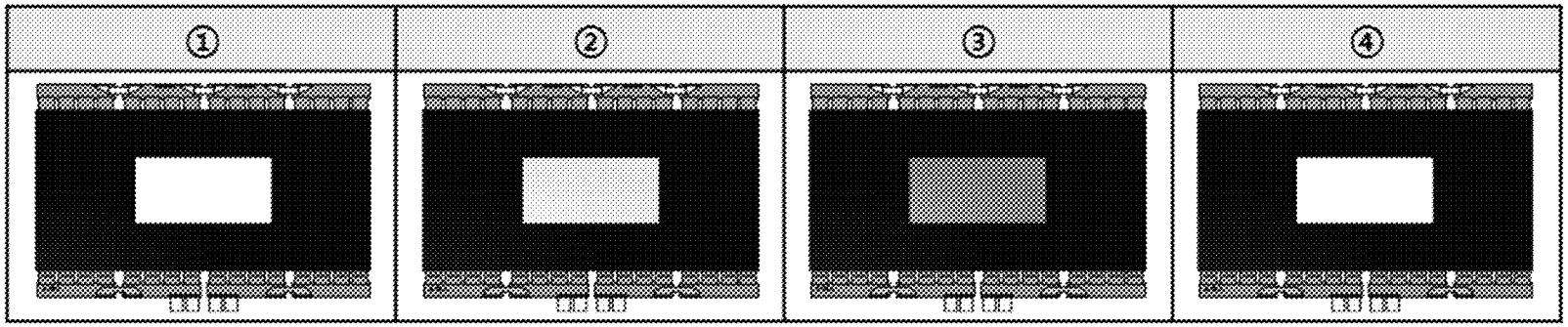

FIG. 3 and FIG. 4 illustrate changes depending on a screen saver operation in a display device according to an embodiment.

When the total load value for consecutive frames and the load value for each block are substantially unchanged for a continuous predetermined time or more, a screen saver operation for reducing luminance may be performed, as illustrated in FIG. 3.

In a graph of FIG. 3, an x-axis represents time, and a y-axis represents a gain value.

First, when the total load value and the load value for each block are substantially constant for a predetermined time (t1) (period ①), from the display screen saver (DSS) operation start time, the display luminance is decreased for period ② with the gain value being linearly reduced. The gain value continues to decrease to a predetermined minimum gain value; from the DSS minimum gain maintenance time, the minimum luminance is continuously displayed for period ③.

Although a time (t2; minimum gain start time) at which the period starts may be predetermined, the period ③ may start at a different time according to embodiments. For example, when the gain value is linearly lowered to reach a predetermined minimum value, the period ③ may be started. Even in such a case, the minimum gain start time t2 may be set using an average time at which the period ③ starts to guide a time point at which step S30 of FIG. 2 may start.

Display luminance is reduced by the screen saver operation to reduce power consumption, and the reduction in power consumption is more effective as the size of the display device increases. In an embodiment, in an organic light emitting diode display, a lifespan of an organic light emitting diode may be prolonged, and/or a burn-in phenomenon may be delayed.

The screen saver operation is performed through the above periods ①, ②, and ③, and then, at DSS reset time, when the user uses (i.e., provides input to) the display device again, the display luminance may be increased to the normal luminance to perform the display operation for period ④, which may follow the screen saver operation.

FIG. 4 illustrates an illuminated area in the display panel for each of the periods ①, ②, ③, and ④.

In the screen saver operation, the display device may show displayed areas (i.e., illuminated areas) at different positions.

Figure 5:
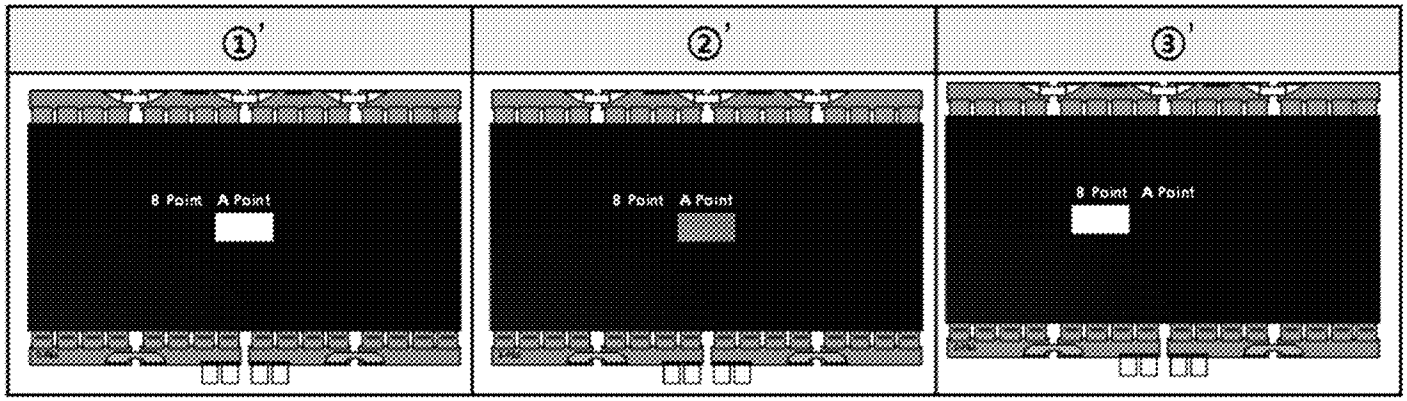
FIG. 5 and FIG. 6 illustrate a display area change (or illuminated area change) and luminance changes in a screen saver operation in a display device according to a comparative example.
Figure 6:
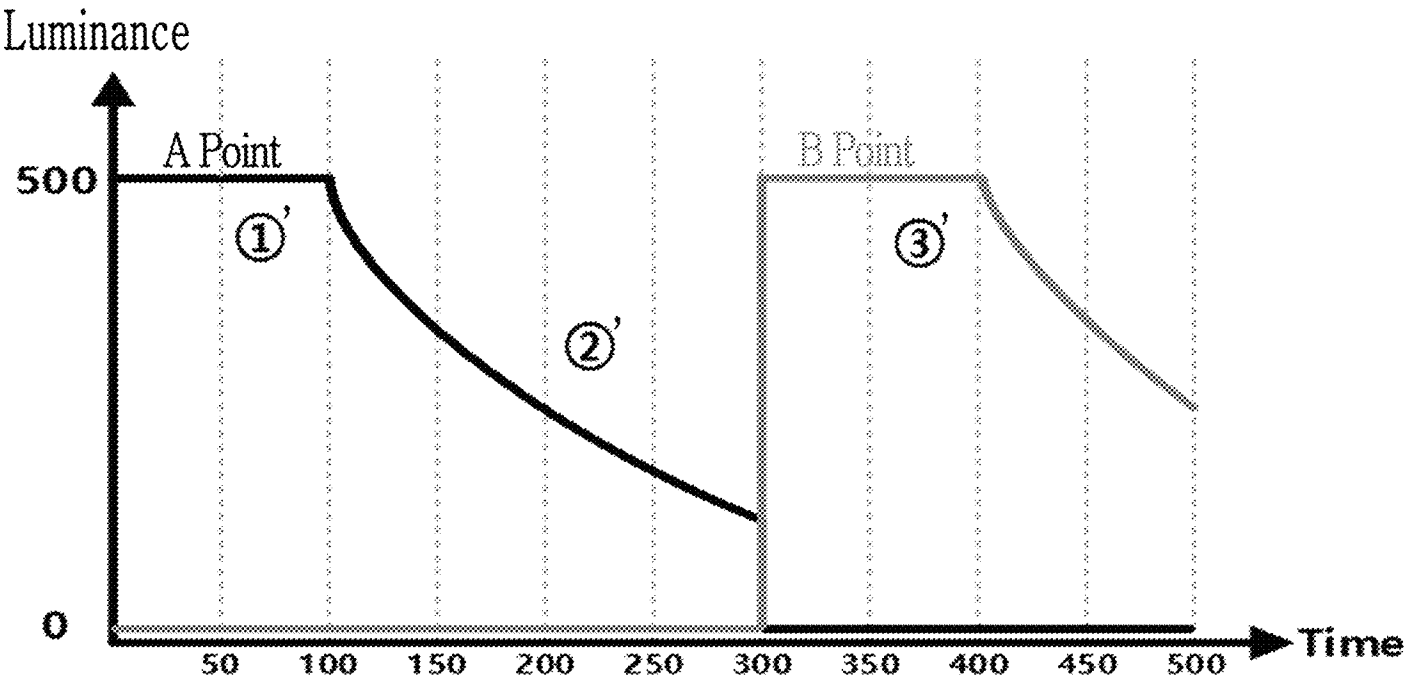

FIG. 5 and FIG. 6 illustrate a display area (or illuminated area) change and luminance changes in a screen saver operation in a display device according to a comparative example.

In FIG. 5, an illuminated area (immediately neighboring or surrounded by an unilluminated area) on the screen saver is changed/moved from a point A (or A point, an area including one or more blocks or block portions) to a point B (or B point, an area including one or more blocks or block portions). FIG. 6 illustrates a change in luminance of the A point and a change in luminance of the B point.

Referring to FIG. 5 and FIG. 6, white (500 nit) is displayed at the point A for a period ①', luminance is reduced in the screen saver operation through a period ②', and black (0 nit) is displayed at the point A when white (500 nit) is displayed at the point B.

At the point A, black (0 nit) is displayed in a period ③', subsequent to the period ①' (in which the display luminance at the point A is 500 nit) and the period ②' (in which the luminance at the point A is reduced).

At the point B, the luminance suddenly increases to 500 nit at the start of the period ③', subsequent to the periods ①' and ②' (in which the display luminance at the point B is 0 nit).

Since the point A and the point B are immediately adjacent, when one suddenly becomes black and the other suddenly becomes white, the user can easily recognize this change. The screen saver operation of the display device may be recognized as strange and incomplete through such recognition, so that the user may consider the display device defective or may feel uncomfortable when using the display device.

In embodiments, even when the position and/or luminance of the displayed area (or illuminated area) is changed during the screen saver operation, different luminance levels may be provided based on the changed position, making the change inconspicuous.

Steps S30 and S40 of FIG. 2 are further described with reference to FIG. 7 to FIG. 10.

FIG. 7 to FIG. 10 illustrate display area changes (or illuminated area changes) and luminance changes in a screen saver operation in a display device according to an embodiment.

FIG. 7 to FIG. 10 illustrate that the display device enters step S30 when there is no substantial change in the total load value between two consecutive frames in step S10 of FIG. 2, and there is load value change for one or more blocks in step S20.

Figure 7:
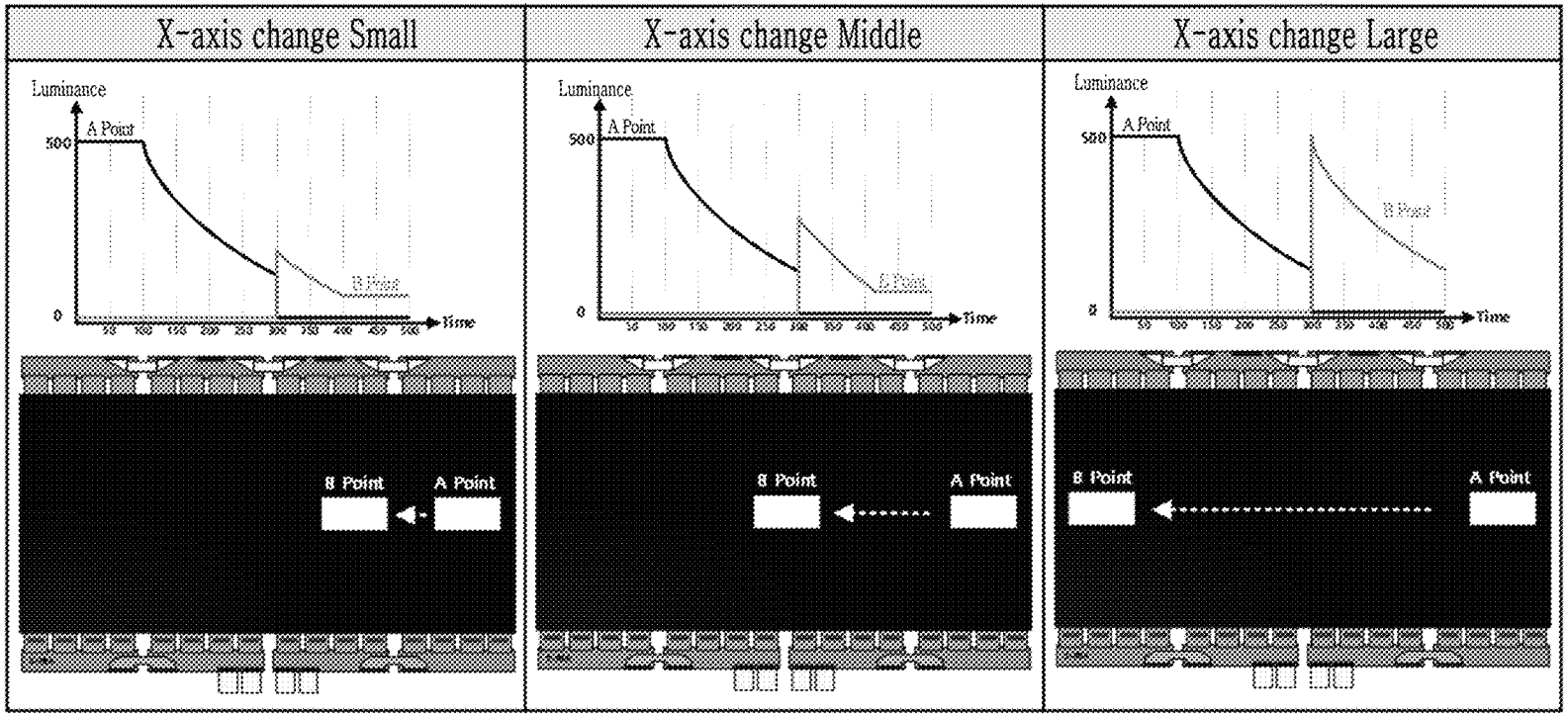
FIG. 7, FIG. 8, FIG. 9, and FIG. 10 illustrate display area changes (or illuminated area changes) and luminance changes in a screen saver operation in a display device according to an embodiment.
Figure 9:
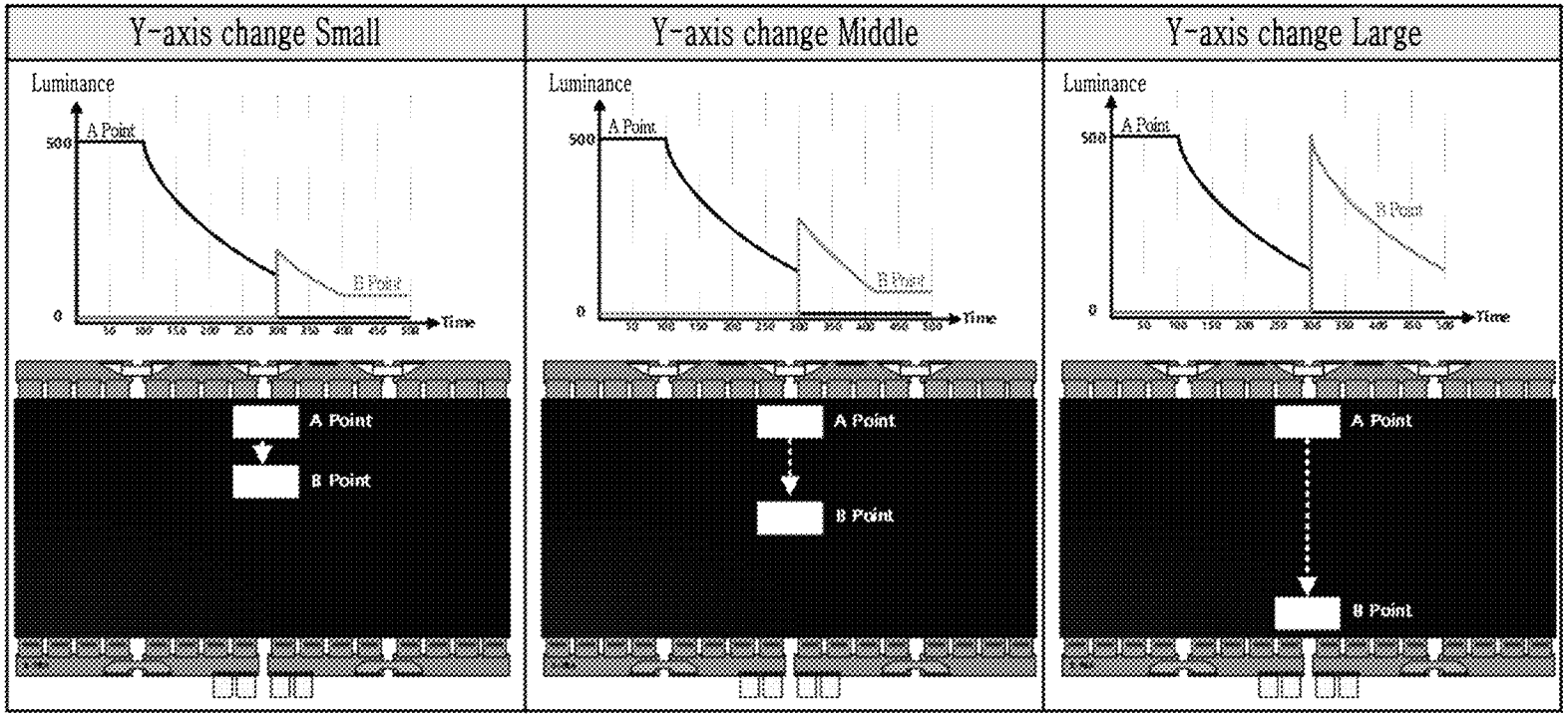

Referring to FIG. 7 and FIG. 9, in the screen saver operation, white is displayed at the point A (or the point A is illuminated) in step S30 (step of checking the distance between blocks having different load values for each block). Subsequently, a video signal is inputted to allow white to be displayed at the point B.

A case where the display area (or illuminated area) is moved in the x-axis direction will be described with reference to FIG. 7 and FIG. 8.

When the distance between the two blocks (or two illuminated areas) in the x-axis direction checked in step S30 is small, the luminance at the point B is not increased to the luminance of white (500 nit), and the luminance at the point B may represent a gray that is lower than a middle gray. That the distance between the two blocks checked in step S30 is small may mean that the distance is smaller than a first reference distance. The first reference distance may be set according to one or more factors, such as the size of the display device and/or the number of blocks in the display panel.

When the distance between the two blocks (or two illuminated areas) checked in step S30 is large, the luminance displayed at the point B may be increased to the luminance of white (500 nits). That the distance between the two blocks checked in step S30 is large may mean that the distance is greater than a second reference distance. The second reference distance may be set according to one or more factors, such as the size of the display device and/or the number of blocks in the display panel.

When the distance between the two blocks checked in step S30 is between the first reference distance and the second reference distance, the luminance displayed at the point B may be the luminance of a middle gray level. According to an embodiment, the luminance displayed at the point B may be middle luminance between the luminance associated with the above small distance and the luminance associated with the above large distance.

According to embodiments, a gain value is adjusted and is multiplied by image data to determine a final data voltage in order to adjust the luminance displayed depending on a distance between blocks (or illuminated areas) where the load values are changed.

Figure 8:
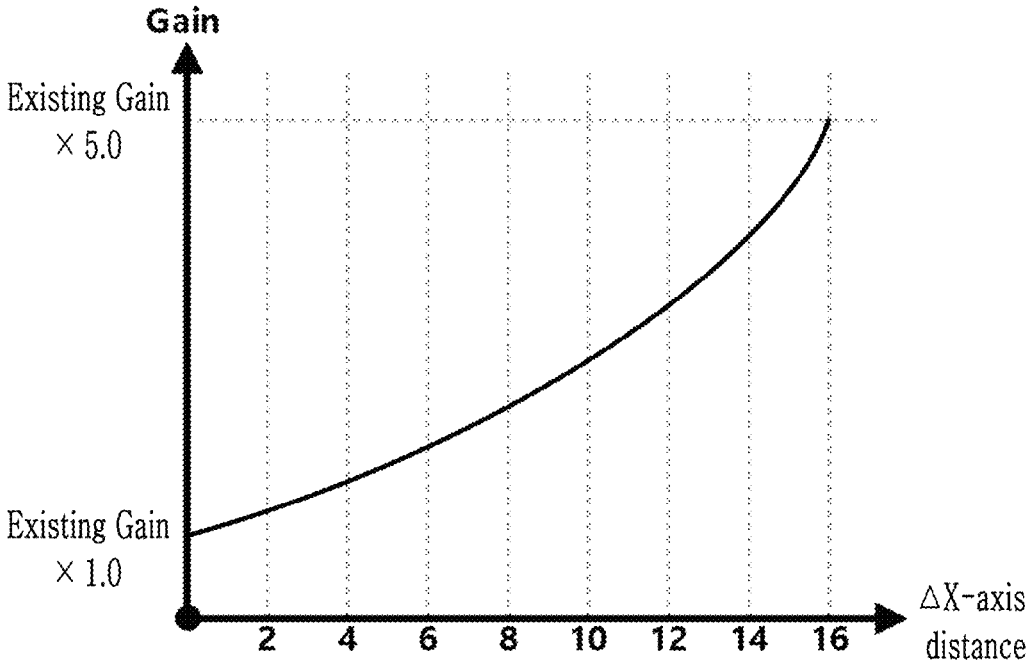

FIG. 8 illustrates an example in which a gain value is configured depending on a distance value (a distance-related number). In FIG. 8, the x-axis represents a distance in the x-axis direction, indicated by the number of blocks between two illuminated areas, and the y-axis represents a gain value. In FIG. 8, an existing gain indicates a gain value set before the screen saver operation.

Although FIG. 8 illustrates a gain value that varies non-linearly according to the distance, the gain value may be set to vary linearly, or may be set to have a constant gain value for a range of distance values.

A case where the display area (or illuminated area) is moved in the y-axis direction is described with reference to FIG. 9 and FIG. 10.

When the distance between the two blocks (or two illuminated areas) checked in step S30 is small, the luminance at the point B may not be increased to the luminance of white (500 nit), and the luminance at the point B may represent a gray lower than a middle gray. That the distance between the two blocks checked in step S30 is small may mean that the distance is smaller than a third reference distance. The third reference distance may be set according to one or more factors, such as the size of the display device and/or the number of blocks in the display panel.

When the distance between the two blocks (or two illuminated areas) checked in step S30 is large, the luminance displayed at the point B may be increased to the luminance of white (500 nits). That the distance between the two blocks checked in step S30 is large may mean that the distance is greater than a fourth reference distance. The fourth reference distance may be set according to one or more factors, such as the size of the display device and/or the number of blocks in the display panel.

When the distance between the two blocks checked in step S30 is between the third reference distance and the fourth reference distance, the luminance displayed at the point B may be the luminance of a middle gray level. According to an embodiment, the luminance displayed at the point B may be middle luminance between the luminance associated with the above small distance and the luminance associated with the above large distance between the two blocks in the x-axis direction checked in step S30 is large.

According to embodiments, a gain value is adjusted and is multiplied by image data to determine a final data voltage in order to adjust the luminance.

Figure 10:
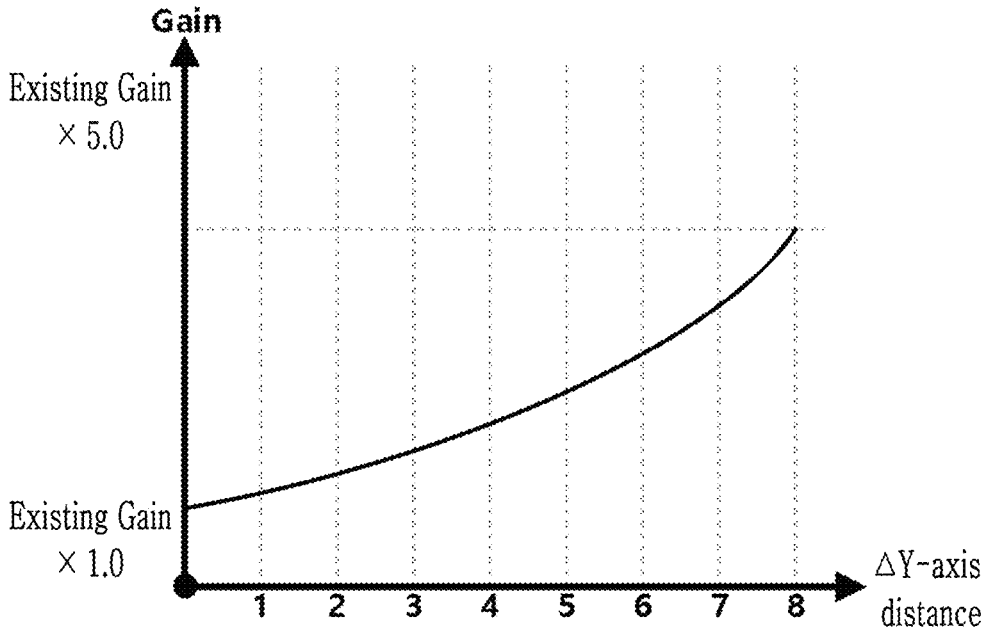

FIG. 10 illustrates an example in which a gain value is configured depending on a distance value (a distance-related number). In FIG. 10, the x-axis represents a distance in the y-axis direction, indicated by the number of blocks between two illuminated areas, and the y-axis represents a gain value. In FIG. 10, an existing gain indicates a gain value set before the screen saver operation.

Although FIG. 10 illustrates a gain value that varies non-linearly according to the distance, the gain value may be set to vary linearly, or may be set to have a constant gain value for a range of distance values.

A distance value (a distance-related number) between the two blocks (or two illuminated areas) illustrated in FIG. 7 to FIG. 10 may not be an actual distance value (or length), but may be represented by the number of blocks disposed between the two blocks (or two illuminated areas). In embodiments, when two adjacent blocks have changed load values, the distance information/number may be 1 (or 0); when two blocks having changed load values are spaced from each other by exactly one block, the distance information/number may be 2 (or 1).

The operation of steps S30 and S40 illustrated in FIG. 7 to FIG. 10 can be applied only when a predetermined time (see t2 in FIG. 3) or more is performed. Compensation for the screen saver operation through the steps S30, S40, and S50 is to prevent a user from feeling discomfort while recognizing a luminance value drop during the screen saver operation as the luminance value is rapidly increased. Thus, it may not be necessary to perform steps S30, S40, and S50 when the user cannot visually recognize a change in display luminance that has not decreased much shortly after the screen saver operation has been performed.

Each of the points A and B in FIG. 7 to FIG. 10 may be or correspond to one block or a plurality of blocks. Each of the points A and B may be or correspond to a portion of one block. When they correspond to a plurality of blocks, it may be necessary to compare position information between the blocks.

Figure 12:
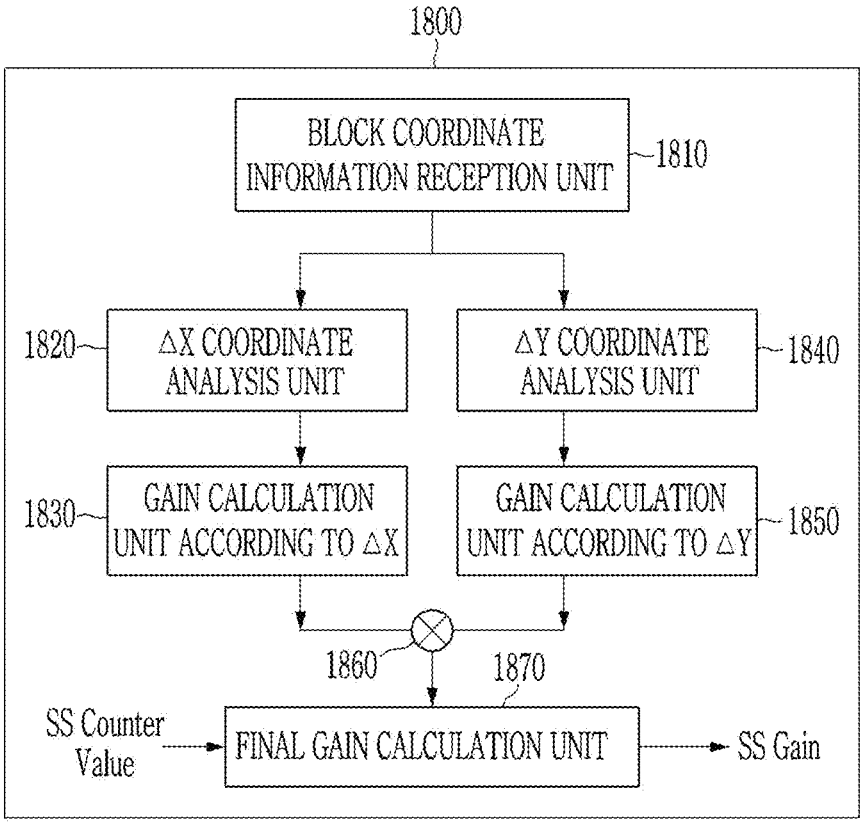
FIG. 12 illustrates a block diagram of a gain determining unit in a timing controller of a display device according to an embodiment.

In FIG. 7 to FIG. 10, the case where the display area (or illuminated area) is moved in one axial direction of the x-axis or the y-axis has been described as examples. The display area (or illuminated area) may be moved in both directions of the x-axis and the y-axis, and in this case, as illustrated in FIG. 12, two distance-gain information sets/values may be synthesized, and a final gain value may be calculated based on the synthesized information sets/values. There may be various ways to synthesize the two information sets/values. For example, the larger of the two values, an average value, multiplying of the two values, or a sum of the two values may be used.

Figure 11:
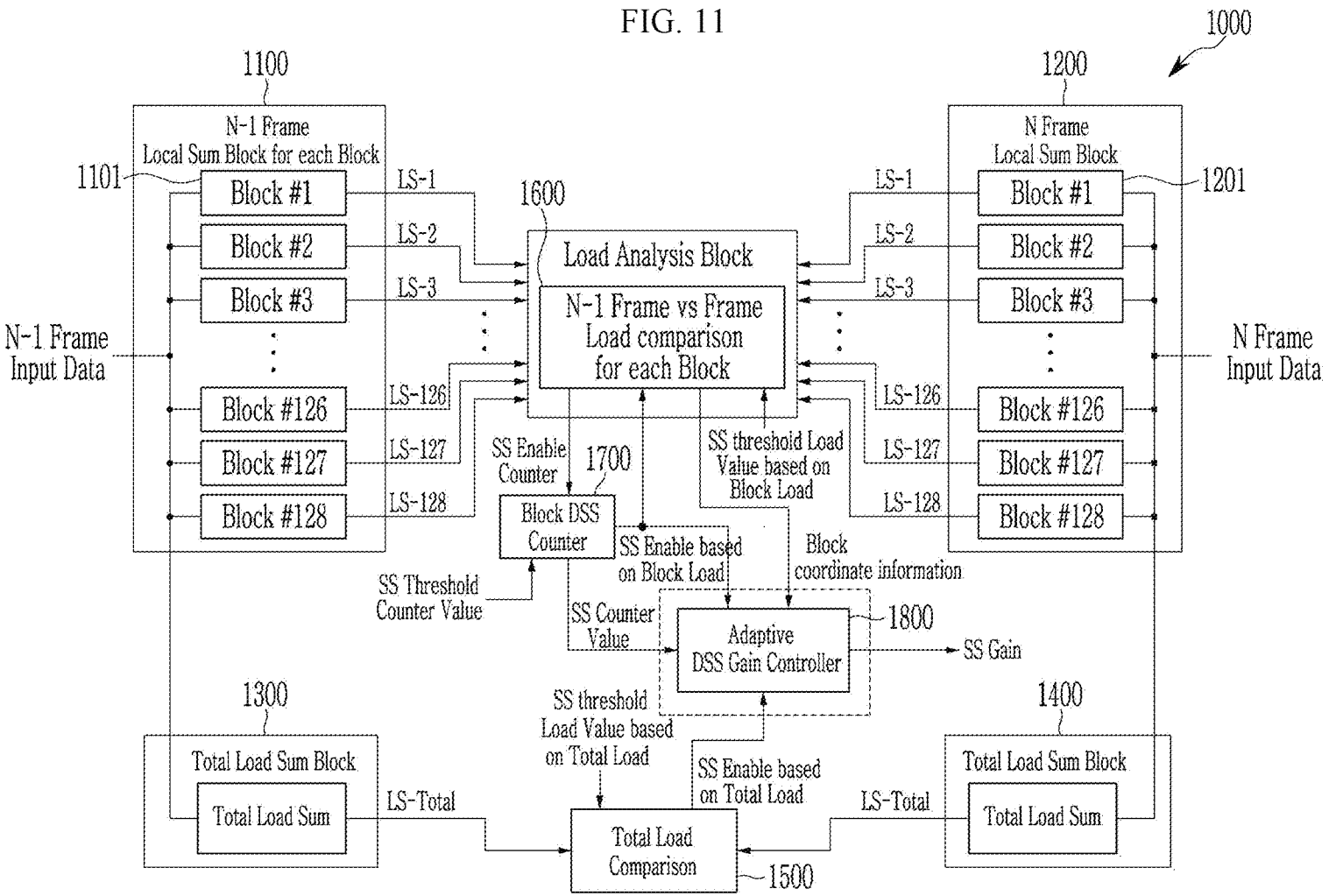
FIG. 11 illustrates a block diagram showing a timing controller of a display device according to an embodiment.

FIG. 11 illustrates a block diagram showing a timing controller 1000 of a display device according to an embodiment.

The timing controller 1000 includes frame memories 1100 and 1200 (which may include one or more hardware circuits), total load summation units 1300 and 1400, a total load comparison unit 1500, a block load comparison unit 1600, a counter 1700, and a gain determination unit 1800.

A pair of frame memories 1100 and 1200 store one frame of image data, and include 128 frame memories 1101 and 1201 for each block.

In FIG. 11, image data of a current frame N Frame is stored in the right frame memory 1200, and image data of a previous frame (N−1) Frame is stored in the left frame memory 1100. According to an embodiment, when image data of an odd-numbered frame is stored in the left frame memory 1100, image data of an even-numbered frame may be stored in the right frame memory 1200.

In the frame memories 1101 and 1201 for each block, image data for one frame transferred to the corresponding block is stored.

The image data stored in the frame memories 1100 and 1200 is transferred to the total load summation units 1300 and 1400 and the block load comparison unit 1600.

First, a path through which the image data is transferred to the total load summation units 1300 and 1400 is described.

The image data of one frame stored in each of the frame memories 1100 and 1200 is transferred to the total load summation units 1300 and 1400, respectively, and a total load value LS-Total of the image data is calculated.

A total load value of the previous frame (N−1) Frame and a total load value LS-Total of the current frame N Frame are transferred to the total load comparison unit 1500. The total load comparison unit 1500 performs comparison to determine whether there is no difference in the total load values LS-Total of the two input frames to check whether or not there is a change. The comparing in the total load comparison unit 1500 corresponds to step S10 of FIG. 2. The total load comparison unit 1500 outputs an enable signal (SS Enable based on Total Load) to the gain determination unit 1800 when there is no difference in the total load values LS-Total of the two frames. The total load comparison unit 1500 may be configured to output the enable signal (SS Enable based on Total Load) when a threshold value (SS threshold Load Value based on Total Load; hereinafter also referred to as the threshold for the total load value) for outputting the enable signal (SS Enable based on Total Load) completely matches the total load values LS-Total of the two frames according to the setting, or when the difference is smaller than or equal to the threshold value (SS threshold Load Value based on Total Load). The threshold value (SS threshold Load Value based on Total Load) may be configured by the user.

A path through which the image data stored in the frame memories 1100 and 1200 is transferred to the block load comparison unit 1600 is described.

The image data stored in the frame memories 1101 and 1201 for each block of the frame memories 1100 and 1200 are transferred to the load comparison unit 1600 for each block, and the load value of each block is compared based on the same block to check whether there is any (significant) difference and whether there is a (significant) change. The comparing in the block comparison unit 1600 corresponds to step S20 of FIG. 2.

In FIG. 11, a load value LS-1 of a first block of the previous frame (N−1) Frame is compared with a load value LS-1 of a first block of the current frame N Frame, and a load value LS-2 of a second block of the previous frame (N−1) Frame is compared with a load value LS-2 of a second block of the current frame N Frame. The load values for each block are sequentially compared, and the operation ends after comparing the load value LS-128 of the 128th block of the previous frame (N−1) Frame and the 128th block LS-128 of the 128th block of the current frame N Frame.

As a result, the block load comparison unit 1600 may identify a block having a difference, and outputs position information (block coordinate information) of the block having a difference to the gain determination unit 1800. The block load comparison unit 1600 may output the position information (block coordinate information) of the block when an enable signal (SS Enable based on Block Load) is received from the counter 1700.

Each block may be treated as if there is no difference in the load values when the load value for the block is completely unchanged, and/or when the difference is smaller than or equal to a threshold value (SS threshold Load Value based on Block Load; hereinafter also referred to as threshold value for load value for each block). The threshold value (SS threshold Load Value based on Block Load) may be predetermined. The threshold value (SS threshold Load Value based on Block Load) may be configured by the user.

The counter 1700 receives a signal (SS Enable Counter) from the block load comparator 1600 and counts a number of blocks, and outputs a final counted value (SS Counter Value) to the gain determiner 1800.

The number of blocks counted in the counter 1700 is information for checking how much time has passed. It may be possible to check a total elapsed time by continuously counting the number of blocks for a total frames, which is used as time information required to change the luminance or gain value over time illustrated in FIG. 3, FIG. 7, and FIG. 9. In the embodiment of FIG. 11, the counted number of blocks is used instead of the time information. According to an embodiment, the counter 1700 may obtain the time information by counting only the number of frames.

The counter 1700 compares a threshold value (SS Threshold Counter Value; hereinafter also referred to as a counter threshold value) with the final counted value (SS Counter Value) and generate the enable signal (SS Enable based on Block Load) to output it to the block load comparison unit 1600 and the gain determination unit 1800 when the final counted value (SS Counter Value) exceeds the threshold value (SS Threshold Counter Value).

The threshold value (SS Threshold Counter Value) of the counter 1700 may be the length of time t1 of the screen saver operation, which determines the time at which the period ② starts, illustrated in FIG. 3. In this case, the block load comparison unit 1600 and the gain determination unit 1800 may perform the screen saver operation by the enable signal (SS Enable based on Block Load) outputted from the counter 1700.

The threshold value (SS Threshold Counter Value) of the counter 1700 may further include a value corresponding to a time point at which the period starts, illustrated in FIG. 3, which corresponds to a minimum gain start time at the end of time t2. In this case, the block load comparison unit 1600 and the gain determination unit 1800 may perform the steps S30, S40, and S50 of FIG. 2 by the enable signal (SS Enable based on Block Load) outputted from the counter 1700.

The gain determining unit 1800 receives the enable signal (SS Enable based on Total Load), the enable signal (SS Enable based on Block load), the final counted value (SS Counter Value) of the total load comparator (1500), and the block position information (Block coordinate information) for blocks with (significant) differences in the block load comparison unit 1600 to output the final gain value (SS Gain).

An operation of the gain determination unit 1800 is further described with reference to FIG. 12.

FIG. 12 illustrates a block diagram of the gain determining unit 1800 according to an embodiment.

The gain determination unit 1800 includes a block coordinate information reception unit 1810, coordinate analysis units 1820 and 1840, gain calculation units 1830 and 1850, a synthesis unit 1860, and a final gain calculation unit 1870.

The block coordinate information reception unit 1810 receives position information (block coordinate information) of a block having a different load value from the block load comparison unit 1600, and then transfers the position information to the coordinate analysis units 1820 and 1840.

The coordinate analysis units 1820 and 1840 include a ΔX coordinate analysis unit 1820 and a ΔY coordinate analysis unit 1840. An x-axis distance and/or a y-axis distance between two blocks (or two illuminated areas) with changed load values are calculated based on the block coordinate information. The x-axis distance and the y-axis distance may not be actual lengths, but may be represented by (a function of) the number of blocks disposed between the two blocks (or two illuminated areas). In embodiments, when two immediately adjacent blocks have changed load values, distance information may be 1 (or 0); when two blocks having changed load values are spaced from each other by exactly one block, the distance information may be 2 (or 1).

The x-axis distance (ΔX) between blocks calculated by the ΔX coordinate analysis unit 1820 is inputted into the gain calculation unit 1830 to obtain a gain value for the x-axis distance. An x-axis gain value (gain according to ΔX) may be determined through a graph (or function) illustrated in FIG. 8.

The y-axis distance (ΔY) between blocks calculated by the ΔY coordinate analysis unit 1840 is inputted into the gain calculation unit 1850 to obtain a gain value for the y-axis distance. A y-axis gain value (gain according to ΔY) may be determined through a graph (or function) illustrated in FIG. 10.

The x-axis gain value (gain according to ΔX) and the y-axis gain value (gain of ΔY) are transferred to the synthesis unit 1860.

The synthesis unit 1860 synthesizes the x-axis gain value (gain according to ΔX) and the y-axis gain value (gain according to ΔY). A method of synthesizing the gain values depending on the total distance may be determined according to embodiments. For example, a method of selecting a larger value from the x-axis gain value (gain according to ΔX) and the y-axis gain value (gain according to ΔY) may be used. According to an embodiment, an average value of the two values, multiplying of the two values, or a sum of the two values may be used.

The synthesized gain value is transferred to the final gain calculation unit 1870.

The final gain calculation unit 1870 calculates a final gain value SS Gain by using the synthesized gain value and a final counted value SS Counter Value inputted from the counter 1700. The final gain calculation unit 1870 may include a lookup table stored in a hardware memory unit, and the lookup table may store the final gain value SS Gain for the synthesized gain value and the final counted value SS Counter Value inputted from the counter 1700.

In an embodiment, the final counted value SS Counter Value includes time information.

The final gain value SS Gain enables different luminance levels depending on the distance by which the display area (or illuminated area neighboring or surrounded by an unilluminated area) is moved during the screen saver operation. In an embodiment, when the distance is short, the luminance is not rapidly/significantly increased, so that the user cannot feel a difference in luminance, and when the distance is long, it is difficult for the user to recognize the difference in luminance, so the display luminance can be set high.

As a result, the user does not feel discomfort when using the screen saver.

While example embodiments have been described, practical embodiments are not limited to the described embodiments. Practical embodiments cover various modifications and equivalent arrangements within the scope of the appended claims.

What is claimed is:

1. A display device comprising:

a display panel;

a data driver electrically connected to the display panel and configured to apply a first data voltage set and subsequently a second data voltage set to the display panel during a screen saver operation of the display device, wherein the first data voltage set causes the display panel to display a first illuminated area immediately neighboring a first unilluminated area, and wherein the second data voltage set causes the display panel to display a second illuminated area immediately neighboring a second unilluminated area; and a timing controller electrically connected to the data driver and configured to supply image data to the data driver for the second data voltage set to cause the second illuminated area to have a luminance level, wherein the timing controller determines a luminance-related value for controlling the luminance level based on a distance-related number that depends on a distance between a position of the first illuminated area and a position of the second illuminated area.

2. The display device of claim 1, wherein the timing controller determines the luminance-related value to be a first value when the distance-related number is a first number, and wherein the timing controller determines the luminance-related value to be a second value greater than the first value when the distance-related number is a second number greater than the first number.

3. The display device of claim 2, wherein the first number is less than a first reference number, wherein the second number is greater than a second reference number, and wherein the timing controller determines the luminance-related value to be greater than the first value and less than the second value when the distance-related number is greater than the first reference number and less than the second reference number.

4. The display device of claim 1, wherein the display panel is divided into blocks arranged in a matrix form, and wherein the distance-related number is a quantity of one or more of the blocks.

5. The display device of claim 1, wherein when the first illuminated area has been illuminated for a predetermined time or longer, the timing controller causes luminance of the first illuminated area to gradually decrease to a predetermined luminance level.

6. The display device of claim 1, wherein the display panel is divided into blocks, and wherein the timing controller includes:

a first frame memory;

a second frame memory;

a first total load summation unit connected to the first frame memory;

a second total load summation unit connected to the second frame memory;

a total load comparison unit connected to each of the first total load summation unit and the second total load summation unit;

a block load comparison unit connected to each of the first frame memory and the second frame memory; and a gain determination unit configured to receive outputs of the total load comparison unit and the block load comparison unit to determine the luminance-related value.

7. The display device of claim 6, wherein the timing controller further includes a counter configured to transfer a counted value to the gain determination unit.

8. The display device of claim 7, wherein the counter outputs an enable signal to activate the block load comparison unit and the gain determination unit.

9. The display device of claim 8, wherein the counter compares the counted value with a counter threshold value, and wherein the counter outputs the enable signal when the counted value is greater than the counter threshold value.

10. The display device of claim 7, wherein the gain determination unit receives block coordinate information from the block load comparison unit to calculate the luminance-related value, and wherein the block coordinate information is related to the position of the second illuminated area.

11. The display device of claim 10, wherein the gain determination unit includes: a block coordinate information reception unit configured to receive the block coordinate information from the block load comparison unit; a first coordinate analysis unit and a second coordinate analysis unit configured to respectively recognize x-axis distance information and y-axis distance information using the block coordinate information; a first gain calculation unit configured to obtain an x-axis gain value based on the x-axis distance information; a second gain calculation unit configured to obtain a y-axis gain value based 36 on the y-axis distance information; a synthesis unit configured to synthesize the x-axis gain value and the y-axis gain value to generate a synthesized gain value; and a gain calculation unit configured to calculate the luminance-related value based on the synthesized gain value.

12. The display device of claim 11, wherein the gain calculation unit receives the counted value from the counter to determine the luminance-related value based on the counted value.

13. The display device of claim 6, wherein the total load comparison unit compares a threshold value with a difference between a total load value of the first total load summation unit and a total load value of second total load summation unit, and wherein the total load comparison unit outputs no enable signal to the gain determination unit when the difference is smaller than the threshold value.

14. The display device of claim 6, wherein the first frame memory stores first image data related to a previous frame for all of the blocks, wherein the second frame memory stores second image data related to a current frame for all of the blocks, wherein the block load comparison unit compares a load threshold value with a difference between values stored in the first frame memory and the second frame memory for each of blocks, and wherein the block load comparison unit treats a load value of a block as unchanged when a difference associated with the block is smaller than the load threshold value.

15. An operating method of a display device that comprises a display panel, the method comprising:

a first step of comparing a total load value of a previous frame and a total load value of a current frame to check a first condition related to whether a total load change exceeds a total load change threshold;

a second step of comparing a load value of the previous frame and a load value of the current frame for each block to check a second condition related to whether a block load change exceeds a block load change threshold;

a third step of performing a screen saver operation when both the first condition and the second condition are false; and a fourth step of adjusting luminance of a second illuminated area on the display panel based on a distance between a positon of the second illuminated area and a position of a first illuminated area on the display panel when the first condition is false but the second condition is true, wherein the first illuminated area immediately neighbors a first unilluminated area on the display panel, and wherein the second illuminated area immediately neighbors a second unilluminated area on the display panel.

16. The display device of claim 15, wherein the fourth step includes:

setting the luminance of the second illuminated area to a first luminance level when the distance is represented by a first number; and setting the luminance of the second illuminated area to be a second luminance level higher than the first luminance level when the distance is represented by a second number greater than the first number.

17. The display device of claim 15, wherein the total load change threshold is greater than zero.

18. The display device of claim 15, wherein the block load change threshold is greater than zero.

19. The display device of claim 15, wherein the fourth step is performed when the third step has been performed for a predetermined time or longer.

20. The display device of claim 15, wherein the third step comprises gradually reducing luminance of the first illuminated area to a predetermined luminance level when the first illuminated area has been illuminated for a predetermined length of time or more.

* * * * *